US007950225B2

(12) United States Patent
Komatsu et al.

(10) Patent No.: US 7,950,225 B2
(45) Date of Patent: May 31, 2011

(54) EXHAUST CONTROL SYSTEM FOR AN INTERNAL COMBUSTION ENGINE

(75) Inventors: Nobuhiro Komatsu, Wako (JP); Norio Suzuki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 806 days.

(21) Appl. No.: 12/002,244

(22) Filed: Dec. 12, 2007

(65) Prior Publication Data

US 2008/0148714 A1 Jun. 26, 2008

(30) Foreign Application Priority Data

Dec. 12, 2006 (JP) ..... 2006-334057

(51) Int. Cl.
*F01N 3/00* (2006.01)

(52) U.S. Cl. ..... 60/295; 60/285; 60/286

(58) Field of Classification Search ..... 60/295
See application file for complete search history.

(56) References Cited

U.S. PATENT DOCUMENTS

| | | | | |
|---|---|---|---|---|
| 6,463,734 | B1 * | 10/2002 | Tamura et al. | 60/277 |
| 6,722,125 | B1 * | 4/2004 | Pfalzgraf | 60/295 |
| 7,054,734 | B2 * | 5/2006 | Todoroki et al. | 701/105 |
| 7,100,365 | B2 * | 9/2006 | Nishizawa et al. | 60/285 |
| 7,197,867 | B2 * | 4/2007 | Huang et al. | 60/295 |
| 2006/0137327 | A1 * | 6/2006 | Shirakawa et al. | 60/285 |

FOREIGN PATENT DOCUMENTS

| | | |
|---|---|---|
| JP | 9-032619 | 2/1997 |
| JP | 9-317524 | 12/1997 |
| JP | 2000-192812 | 7/2000 |
| JP | 2001-65332 | 3/2001 |
| JP | 2004-100476 | 4/2004 |
| JP | 2005-48678 | 2/2005 |
| JP | 2006-183599 | 7/2006 |

OTHER PUBLICATIONS

Japanese Office Action for Application No. 2006-334057, dated Apr. 24, 2009.

Japanese Office Action for Application No. 2006-334057, dated Aug. 25, 2009.

* cited by examiner

*Primary Examiner* — Thomas E Denion
*Assistant Examiner* — Jason Shanske
(74) *Attorney, Agent, or Firm* — Nelson Mullins Riley & Scarborough LLP; Anthony A. Laurentano

(57) ABSTRACT

An exhaust control system for an internal combustion engine provided with an exhaust gas processing device and a NOx purifying catalyst which are arranged in series in an exhaust system, comprises: a first temperature detector for detecting a temperature of the exhaust gas processing device; a second temperature detector for detecting a temperature of the NOx purifying catalyst; a control means for controlling an exhaust temperature to conduct a regeneration process for removing sulfur contents trapped by the NOx purifying catalyst; and a control mode selection means for selecting one of a plurality of exhaust temperature control modes according to a relationship between an output from the first temperature detector and an output from the second temperature detector, wherein the control means conducts exhaust temperature control according to the control mode selected by the control mode selection means.

3 Claims, 6 Drawing Sheets

*Fig.5*

| | | LNC temperature region | | |
|---|---|---|---|---|
| | | A | B | C |
| TWC temperature region | A | Category I | Catgory II | Category III |
| | B | Catgory II | Catgory II | Category III |
| | C | Category III | Category III | Category III |

*Fig.6*

| mode \ category | I | II | III |
|---|---|---|---|
| post-rich | continue post-rich | stop post-injection | combustion rich |
| combustion rich | continue combustion rich | lean | lean |

EXHAUST CONTROL SYSTEM FOR AN INTERNAL COMBUSTION ENGINE

TECHNICAL FIELD

The present invention relates to an exhaust control system for an internal combustion engine, and particularly relates to an exhaust control system for suppressing an excessive temperature increase in the exhaust system when executing a process to remove sulfur contents from a NOx purifying catalyst for reducing and eliminating nitrogen oxides in the exhaust gas.

BACKGROUND OF THE INVENTION

The exhaust passage of a diesel engine is sometimes fitted with a lean NOx catalyst (referred to as LNC hereinafter) for reducing and decreasing nitrogen oxides (referred to as NOx hereinafter), which are particularly generated in a large amount in lean combustion, from the exhaust gas.

The LNC functions to trap (more specifically adsorb) NOx in lean combustion where the oxygen concentration in the exhaust gas is relatively high, and the trapped NOx is reduced into a harmless form and discharged to the atmosphere in rich combustion where the concentration of unburnt components in the exhaust gas is relatively high. The NOx purification ability of the LNC tends to decrease as the amount of trapped NOx increases, and therefore, a control is conducted to make the combustion condition rich from time to time to release and reduce the NOx trapped by the LNC.

Meanwhile, because the fuel includes sulfur contents, sulfur oxides (SOx) and hydrogen sulfides ($H_2S$) are also emitted from the combustion chamber. Such sulfur contents are also adsorbed by the LNC (this state is referred to as sulfur poisoning hereinafter) in the same way as for NOx, and the capability of LNC to adsorb NOx diminishes as the sulfur poisoning proceeds. Therefore, it is necessary to release or remove the sulfur contents adsorbed by the LNC from time to time. In order to carry out the process of releasing sulfur contents from the LNC (referred to as sulfur purging hereinafter), it is necessary to achieve both a prescribed temperature and a prescribed exhaust air fuel ratio (referred to as exhaust A/F hereinafter) in the LNC. As a technique for this, it is known to perform a post-combustion supplementary fuel injection (referred to as post-injection hereinafter) in addition to the main fuel injection conducted during the intake stroke, to thereby make the exhaust A/F rich and raise the LNC temperature so as to be higher than a prescribed value (see Japanese Patent Application Publication (kokai) No. 9-32619, for example).

In such a conventional technique described in JPA Publication No. 9-32619, a feedback control is conducted mainly based on the LNC temperature. However, in a case where an additional exhaust gas processing device other than the LNC is provided in the exhaust system, an activation temperature as well as a detrimental temperature range can be different between the LNC and the additional exhaust gas processing device, and therefore, the exhaust A/F control solely based on the LNC temperature may not be able to maintain an environment favorable to the additional exhaust gas processing device.

BRIEF SUMMARY OF THE INVENTION

The present invention is made to solve such prior art problems, and a primary object of the present invention is to provide an exhaust control system for an internal combustion engine that can prevent an excessive temperature increase during the sulfur purge that could be detrimental to both of a NOx purifying catalyst (LNC) and additional exhaust gas processing device.

To achieve such an object, the present invention provides an exhaust control system for an internal combustion engine provided with an exhaust gas processing device (8) and a NOx purifying catalyst (9) which are arranged in series in an exhaust system, comprising: a first temperature detector (29) for detecting a temperature of the exhaust gas processing device; a second temperature detector (30) for detecting a temperature of the NOx purifying catalyst; a control means (18) for controlling an exhaust temperature to conduct a regeneration process for removing sulfur contents trapped by the NOx purifying catalyst; and a control mode selection means (44) for selecting one of a plurality of exhaust temperature control modes according to a relationship between an output from the first temperature detector and an output from the second temperature detector, wherein the control means conducts exhaust temperature control according to the control mode selected by the control mode selection means.

Typically, the NOx purifying catalyst consists of a lean NOx catalyst INC) and the exhaust gas processing device consists of a three way catalyst (TWC).

According to such a structure, while conducting a sulfur purge, the exhaust temperature control mode can be appropriately determined taking into account both of the temperature of the NOx purifying catalyst and the temperature of the exhaust gas processing device, and therefore it is prevented that the NOx purifying catalyst and the exhaust gas processing device are damaged by an excessively high temperature while conducting the sulfur purge.

In a preferred embodiment, the system further comprises a judgment means (41) for judging whether or not the output from the first temperature detector is above a first predetermined temperature and whether or not the output from the second temperature detector is above a second predetermined temperature, wherein when the output from the first temperature detector is found to be above the first predetermined temperature and/or when the output from the second temperature detector is found to be above the second predetermined temperature, the control mode selection means selects an exhaust temperature control mode that lowers the exhaust temperature.

More concretely, the plurality of control modes comprise a main injection control mode in that an exhaust air fuel ratio (exhaust A/F) is controlled by controlling an amount of main fuel injection during combustion, and a supplemental injection control mode for controlling the exhaust A/F by controlling an amount of supplemental fuel injection (or post-injection) performed after the main fuel injection, wherein when the output from the first temperature detector is found to be above the first temperature or when the output from the second temperature detector is found to be above the second temperature during when the supplemental injection control mode is selected, the control means stops the supplemental injection. For example, in the case that the exhaust gas processing device consists of a TWC and the NOx purifying catalyst consists of an LNC, the first predetermined temperature can be 700° C. and the second predetermined temperature can be 600° C.

Further preferably, when the output from the first temperature detector is found to be beyond a third predetermined temperature that is higher than the first predetermined temperature or when the output from the second temperature is found to be higher than a fourth predetermined temperature that is higher than the second predetermined temperature after the stopping of the supplemental injection, the control mode selection means selects the main injection control mode to make the exhaust A/F rich. This is because the increase of temperature after the stopping of the supplemental injection is considered to indicate that a large amount of unburnt components resulting from the preceding supplemental injection (post-injection) remains in the exhaust system and these unburnt components undergo exothermal reaction under the lean exhaust A/F. Thus, by selecting the main injection control mode to make the exhaust A/F rich, it is possible to reduce the amount of oxygen supplied to the exhaust system to thereby suppress the exothermal reaction of unburnt components so that an excessive temperature increase can be prevented.

According to another aspect of the present invention, there is provided an exhaust control method for an internal combustion engine provided with an exhaust gas processing device and a NOx purifying catalyst which are arranged in series in an exhaust system, the method comprising the steps of: detecting a temperature of the exhaust gas processing device; detecting a temperature of the NOx purifying catalyst; controlling an exhaust temperature to conduct a regeneration process for removing sulfur contents trapped by the NOx purifying catalyst; and selecting one of a plurality of exhaust temperature control modes according to a relationship between an output from the first temperature detector and an output from the second temperature detector, wherein the controlling of exhaust temperature is conducted according to the selected control mode.

According to a further aspect of the present invention, there is provided a computer-readable medium computer-executable instructions for performing the above method.

BRIEF DESCRIPTION OF THE DRAWINGS

Now the present invention is described in the following with reference to the appended drawings, in which:

FIG. 5 is a table showing an example of classification of the relationship between the TWC temperature and LNC temperature; and FIG. 6 is an exemplary table for showing how to determine the control mode from the temperature classification result and the current control mode.

DETAILED DESCRIPTION OF THE PREFERRED EMBODIMENTS

Figure 1:
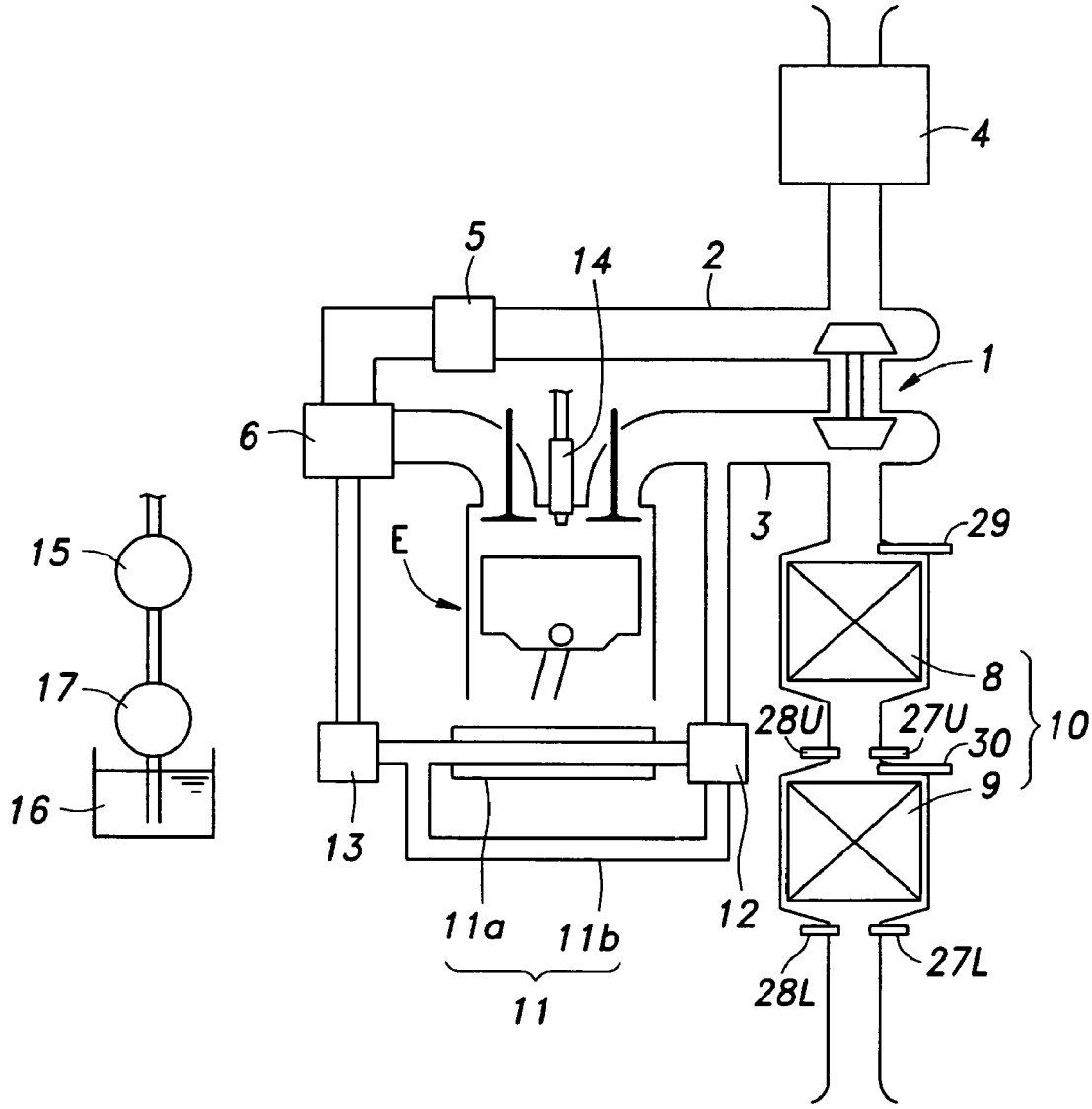
FIG. 1 is an overall structural view of an internal combustion engine to which the present invention is applied.

FIG. 1 is a basic structural view of an internal combustion engine E to which the present invention is applied. The mechanical structure of this internal combustion engine (diesel engine) E is no different from a conventional one, and the engine E comprises a turbocharger 1 equipped with a variable boost pressure mechanism. An intake passage 2 is connected to a compressor side of the turbocharger 1 and an exhaust passage 3 is connected to a turbine side of the turbocharger 1. An air cleaner 4 is connected to an upstream end of the intake passage 2, and an intake control valve 5 for controlling a flow rate of fresh air flowing into a combustion chamber and a swirl control valve 6 for restricting a cross-section of the flow passage to increase the air flow velocity in a low rotational speed/low load operation region are provided at appropriate positions in the intake passage 2. Further, on a downstream side of the exhaust passage with respect to the turbocharger 1 is connected an exhaust gas purifying device 10, which comprises, for example, a three-way catalyst (referred to as TWC hereinafter) 8 having oxidizing and reducing abilities and an LNC 9, where the TWC 8 and the LNC 9 are arranged in this order in the direction of exhaust gas flow. The exhaust gas purifying device 10 also comprises a filter (not shown in the drawings) for removing particulate matter (PM) such as soot.

The swirl control valve 6 and a part of the exhaust passage 3 near the exit of the combustion chamber are connected to each other via an exhaust gas recirculating (hereinafter referred to as EGR) passage 11. This EGR passage 11 comprises a cooler passage 11*a* and a bypass passage 11*b* which are bifurcated at a switching valve 12, and an EGR control valve 13 is provided at a junction of the passages 11*a* and 11*b* for controlling an EGR flow rate toward the combustion chamber.

A fuel injection valve 14 is provided to a cylinder head of the internal combustion engine E such that an end of the fuel injection valve 14 extends into the combustion chamber. The fuel injection valve 14 is connected to a common rail 15 containing fuel at a prescribed high pressure, and the common rail 15 is connected to a fuel pump 17 driven by a crankshaft to pump up fuel from a fuel tank 16.

Figure 2:
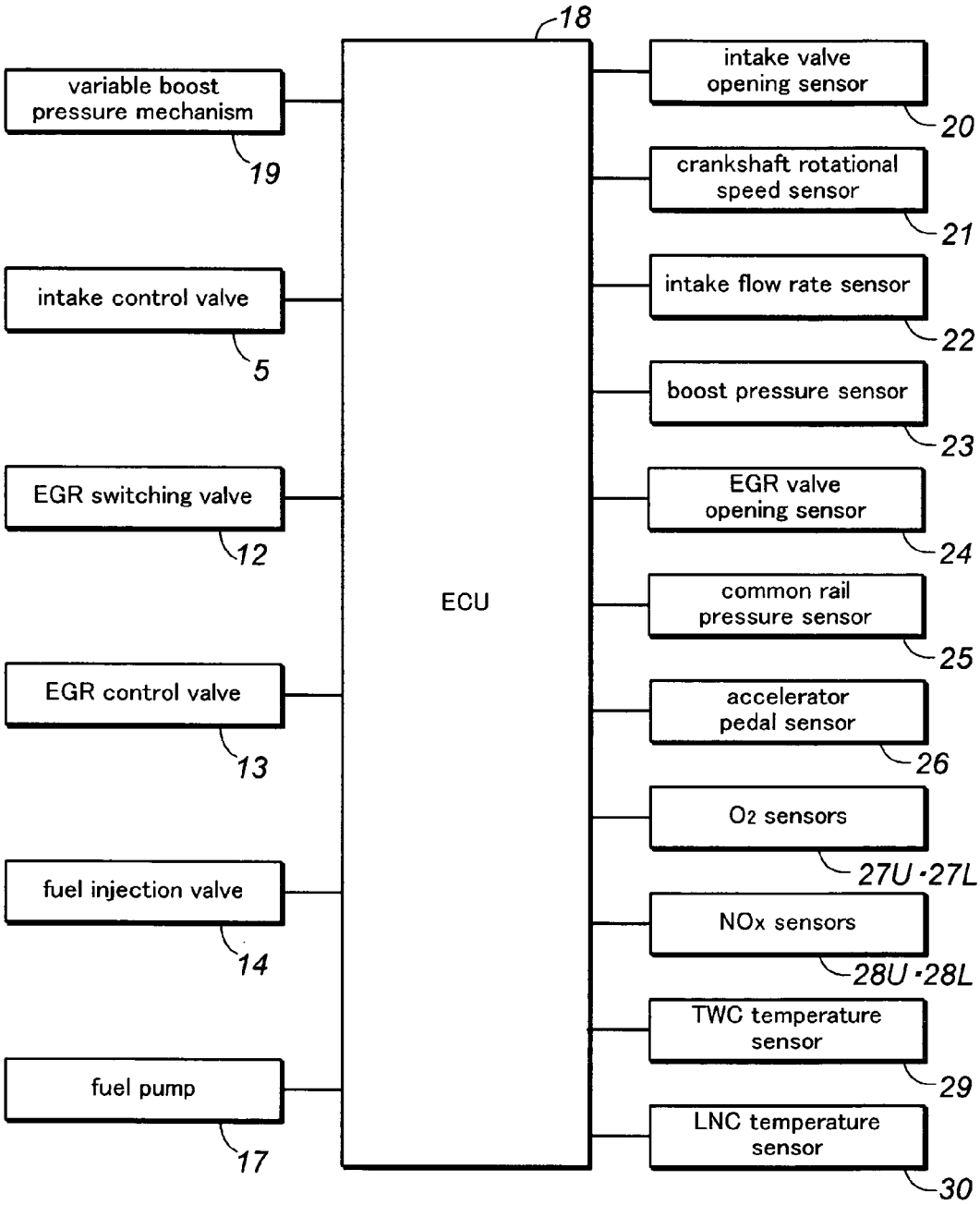
FIG. 2 is a block diagram of a control device to which the present invention is applied.

The variable boost pressure mechanism 19 for the turbocharger 1, the intake control valve 5, EGR passage switching valve 12, EGR control valve 13, fuel injection valve 14, fuel pump 17 and so on are configured to operate according to control signals from an electronic control unit (ECU) 18 (see FIG. 2).

As shown in FIG. 2, the ECU 18 in turn receives signals from an intake valve opening sensor 20, crankshaft rotational speed sensor 21, intake flow rate sensor 22, boost pressure sensor 23, EGR valve opening sensor 24, common rail pressure sensor 25, accelerator pedal sensor 26, $O_2$ sensors 27U and 27L, NOx sensors 28U and 28L, TWC temperature sensor 29, LNC temperature sensor 30 and so on which are provided in appropriate parts of the internal combustion engine E.

A memory for ECU 18 stores a map for setting target values of various controlled quantities such as optimum fuel injection obtained beforehand with respect to crankshaft rotational speed and torque demand (accelerator pedal displacement) which is typically determined experimentally so that the various control quantities may be optimally controlled and an optimum combustion state may be achieved under all load conditions of the internal combustion engine E.

Figure 3:
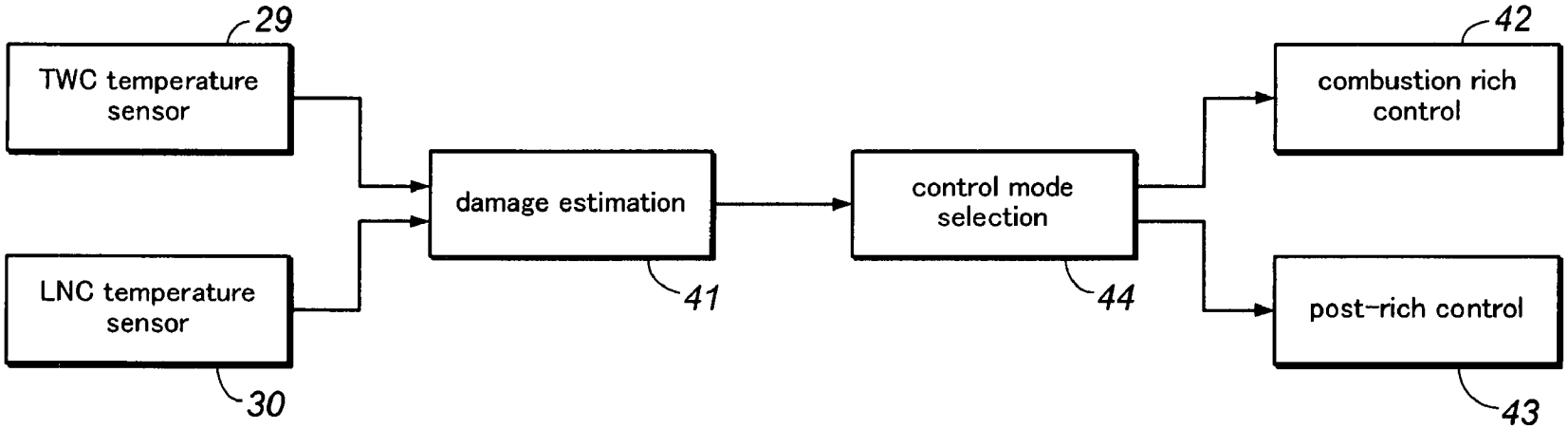
FIG. 3 is a block diagram showing an essential part of the present invention.

Next, an explanation is made to a way of controlling the exhaust temperature (or exhaust A/F) conducted by a preferred embodiment of the exhaust control system according to the present invention. This control system comprises: a damage estimating (or judging) portion 41 for estimating a degree or possibility of damage of the TWC 8 and LNC 9 based on the outputs from a TWC temperature sensor 29 (first temperature detector) and an LNC temperature sensor (second temperature detector); and a control mode selecting portion 44 for selecting, as an exhaust A/F control mode, either one of a combustion rich control 42 in that an amount of main fuel injection conducted during the intake stroke is controlled or a post-rich control 43 in that an amount of supplemental fuel injection conducted after combustion is controlled, according to the estimated damage of the TWC 8 and LNC 9 (FIG. 3).

Figure 4:
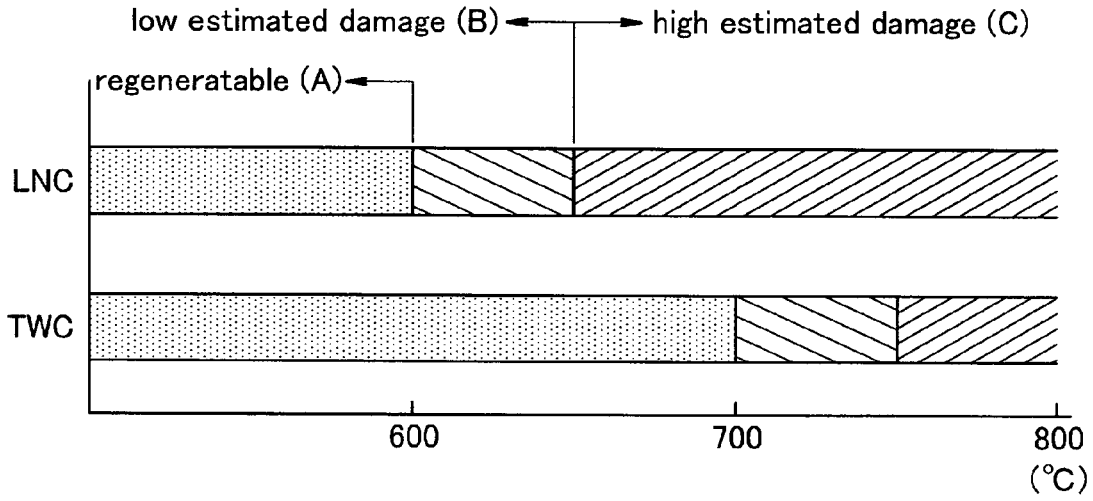
FIG. 4 is a diagram comparatively showing the temperature ranges of a TWC and an LNC.

As shown in FIG. 4, the temperature region of each of the TWC 8 and the LNC 9 is divided into three regions, i.e., a regeneratable region (A), a low detrimental region (B), and a highly detrimental region (C). Specifically, for the TWC 8, the region A is defined as a temperate range equal to or below 700° C., the region B is defined as a temperature range of 700-750° C., and the region C is defined as a temperature range equal to or higher than 750° C. As for the LNC 9, the region A is defined as a temperature range equal to or below 600° C., the region B is defined as a temperature range of 600-650° C., and the region C is defined as a temperature range equal to or higher than 650° C.

While executing the sulfur purge, the outputs from both of the TWC temperature sensor 29 and the LNC temperature sensor 30 are monitored, and an exhaust A/F control mode (or exhaust temperature control mode) is selected based on the relationship between the temperatures detected by these sensors as well as a currently selected control mode.

As shown in FIG. 5, the damage estimating portion 41 makes a determination on the relationship between the TWC temperature and the LNC temperature to classify it into one of three categories (Categories I-III). Category I indicates that both of the TWC temperature and the LNC temperature are in the region A (regeneratable region), which means both of the TWC 8 and LNC 9 suffer no damage. Category II indicates that at least one of the TWC temperature and the LNC temperature is in the region B (low detrimental region) and neither of them is in the region C (highly detrimental region), which means that at least one of the TWC 8 and LNC 9 can suffer a little damage. Category III indicates that at least one of the TWC temperature and the LNC temperature is in the region C, which means that there is a high possibility that at least one of the TWC 8 and the LNC 9 can suffer damage from the high temperature.

Then, based on the above classification of the relationship between the TWC temperature and the LNC temperature as well as on the exhaust A/F control mode conducted at the time when the classifying determination is made, a new exhaust A/F control mode is selected, as shown in FIG. 6.

If the exhaust A/F control mode conducted at the time when the classifying determination is made is the post-rich control and the determination finds that the relationship between the TWC and LNC temperatures is in Category I, it is judged that the current temperature is appropriate and the post-rich control is continued. In case of Category II, it is judged that continuing the supply of unburnt components to the exhaust system would excessively increase the temperature, and accordingly the post-injection is stopped. Here, the feedback control of the exhaust A/F is not conducted. Thus, the amount of unburnt components is decreased and the exhaust A/F becomes relatively lean (17-20) and thus the temperature can be eventually lowered. However, in some cases, unburnt components resulting from the preceding post-injection may remain in the exhaust system and these unburnt components can undergo exothermal reaction under the lean exhaust A/F, which can increase the temperature even higher so that the TWC temperature and/or the LNC temperature may enter the region C. In such a case, the classifying determination of the relationship between the TWC and LNC temperatures results in Category III, and in response thereto, the control mode is switched to the combustion rich control, to whereby feedback-control the main injection during the intake stroke to achieve an exhaust A/F at around 14. This can decrease the oxygen concentration in the exhaust gas, and therefore, even though the unburnt components resulting from the preceding post-rich control remain in the exhaust gas, the exothermic reaction of the unburnt components can be suppressed and thus an excessive temperature increase can be prevented.

On the other hand, if the exhaust A/F control mode selected at the time when the classifying determination is made is the combustion rich control (i.e., the exhaust A/F is maintained at around 14 by the feedback control of the main injection during intake stroke) and the determination finds that the relationship between the TWC and LNC temperatures belongs to Category I, the fuel rich control is continued. This is because that maintaining a proper exhaust gas temperature only by main injection control without post-injection (such as in high load/high rotational speed conditions) is favorable in view of fuel consumption. This also leads to a longer period of reducing atmosphere and thus the sulfur purge can be completed quickly. In case of Category II, a control is made to make the exhaust A/F lean, preferably at 25-30. In such an operation, the sulfur purge is substantially not conducted and thus the operation is the same as a usual lean burn operation. In case of Category III also, the lean burn operation is conducted in the same way. In such cases, because of the previously conducted combustion rich control, there is only a small amount of unburnt components in the exhaust gas, and therefore, the increase of oxygen concentration will not lead to temperature increase and thus the exhaust gas temperature can be lowered.

As described above, according to the present invention, monitoring the temperatures of both of the TWC 8 and the LNC 9 and conducting the exhaust A/F control on these temperatures allows the sulfur purge to be conducted without concern that the TWC 8 and the LNC 9 may be damaged due to an excessive temperature.

Although the present invention has been described in terms of preferred embodiments thereof, it is obvious to a person skilled in the art that various alterations and modifications are possible without departing from the scope of the present invention which is set forth in the appended claims. For example, other than the TWC 8, an exhaust gas processing device may include, but is not limited to, an LNC, oxidizing catalyst, reducing catalyst or DPF (Diesel Particulate Filter) for trapping particulate matter (PM), and the present invention can be also applied to these exhaust gas processing devices. Also, the catalyst temperatures used in the determination for control mode selection may not necessarily be directly measured but can be estimated values obtained from the exhaust gas temperature.

The disclosure of the original Japanese patent application (Japanese Patent Application No. 2006-334057 filed on Dec. 12, 2006) on which the Paris Convention priority claim is made for the present application is hereby incorporated by reference in its entirety.

The invention claimed is:

1. An exhaust control system for an internal combustion engine provided with an exhaust gas processing device and a NOx purifying catalyst which are arranged in series in an exhaust system, comprising:

a first temperature detector for detecting a temperature of the exhaust gas processing device;

a second temperature detector for detecting a temperature of the NOx purifying catalyst;

a control means for controlling an exhaust temperature to conduct a regeneration process for removing sulfur contents trapped by the NOx purifying catalyst;

a control mode selection means for selecting one of a plurality of exhaust temperature control modes according to a relationship between an output from the first temperature detector and an output from the second temperature detector, wherein the control means conducts exhaust temperature control according to the control mode selected by the control mode selection means, wherein the plurality of control modes comprise a main injection control mode in that an exhaust air fuel ratio (exhaust A/F) is controlled by controlling an amount of main fuel injection during combustion, and a supplemental injection control mode for controlling the exhaust A/F by controlling an amount of supplemental fuel injection performed after the main fuel injection; and a judgment means for judging whether or not the output from the first temperature detector is above a first predetermined temperature and whether or not the output from the second temperature detector is above a second predetermined temperature, wherein when the output from the first temperature detector is found to be above the first predetermined temperature and/or when the output from the second temperature detector is found to be above the second predetermined temperature, the control mode selection means selects an exhaust temperature control mode that lowers the exhaust temperature, and wherein when the output from the first temperature detector is found to be above the first temperature or when the output from the second temperature detector is found to be above the second temperature during when the supplemental injection control mode is selected, the control means stops the supplemental injection, and when the output from the first temperature detector is found to be beyond a third predetermined temperature that is higher than the first predetermined temperature or when the output from the second temperature detector is found to be higher than a fourth predetermined temperature that is higher than the second predetermined temperature after the stopping of the supplemental injection, the control mode selection means selects the main injection control mode to make the exhaust A/F rich.

2. An exhaust control method for an internal combustion engine provided with an exhaust gas processing device and a NOx purifying catalyst which are arranged in series in an exhaust system, the method comprising the steps of:

detecting a temperature of the exhaust gas processing device using a first temperature detector;

detecting a temperature of the NOx purifying catalyst using a second temperature detector;

controlling an exhaust temperature to conduct a regeneration process for removing sulfur contents trapped by the NOx purifying catalyst;

selecting one of a plurality of exhaust temperature control modes according to a relationship between an output from the first temperature detector and an output from the second temperature detector, wherein the controlling of exhaust temperature is conducted according to the selected control mode, wherein the plurality of control modes comprise a main injection control mode in that an exhaust air fuel ratio (exhaust A/F) is controlled by controlling an amount of main fuel injection during combustion, and a supplemental injection control mode for controlling the exhaust A/F by controlling an amount of supplemental fuel injection performed after the main fuel injection; and judging whether or not the output from the first temperature detector is above a first predetermined temperature and whether or not the output from the second temperature detector is above a second predetermined temperature, wherein when the output from the first temperature detector is found to be above the first predetermined temperature and/or when the output from the second temperature detector is found to be above the second predetermined temperature, the step of selecting selects an exhaust temperature control mode that lowers the exhaust temperature, and wherein when the output from the first temperature detector is found to be above the first temperature or when the output from the second temperature detector is found to be above the second temperature during when the supplemental injection control mode is selected, the step of controlling stops the supplemental injection, and when the output from the first temperature detector is found to be beyond a third predetermined temperature that is higher than the first predetermined temperature or when the output from the second temperature detector is found to be higher than a fourth predetermined temperature that is higher than the second predetermined temperature after the stopping of the supplemental injection, the step of selecting selects the main injection control mode to make the exhaust A/F rich.

3. A non-transitory computer-readable medium having computer-executable instructions for performing an exhaust control method for an internal combustion engine provided with an exhaust gas processing device and a NOx purifying catalyst which are arranged in series in an exhaust system, the method comprising the steps of:

detecting a temperature of the exhaust gas processing device using a first temperature detector;

detecting a temperature of the NOx purifying catalyst using a second temperature detector;

controlling an exhaust temperature to conduct a regeneration process for removing sulfur contents trapped by the NOx purifying catalyst;

selecting one of a plurality of exhaust temperature control modes according to a relationship between an output from the first temperature detector and an output from the second temperature detector, wherein the controlling of exhaust temperature is conducted according to the selected control mode, wherein the plurality of control modes comprise a main injection control mode in that an exhaust air fuel ratio (exhaust A/F) is controlled by controlling an amount of main fuel injection during combustion, and a supplemental injection control mode for controlling the exhaust A/F by controlling an amount of supplemental fuel injection performed after the main fuel injection; and judging whether or not the output from the first temperature detector is above a first predetermined temperature and whether or not the output from the second temperature detector is above a second predetermined temperature, wherein when the output from the first temperature detector is found to be above the first predetermined temperature and/or when the output from the second temperature detector is found to be above the second predetermined temperature, the step of selecting selects an exhaust temperature control mode that lowers the exhaust temperature, and wherein when the output from the first temperature detector is found to be above the first temperature or when the output from the second temperature detector is found to be above the second temperature during when the supplemental injection control mode is selected, the step of controlling stops the supplemental injection and when the output from the first temperature detector is found to be beyond a third predetermined temperature that is higher than the first predetermined temperature or when the output from the second temperature detector is found to be higher than a fourth predetermined temperature that is higher than the second predetermined temperature after the stopping of the supplemental injection, the step of selecting selects the main injection control mode to make the exhaust A/F rich.

* * * * *